United States Patent [19]

Kentosh

[11] 4,309,955

[45] Jan. 12, 1982

[54] RISER-TO-VESSEL-MOORING-TERMINAL

[75] Inventor: James M. Kentosh, Los Angeles, Calif.

[73] Assignee: Amtel, Inc., Providence, R.I.

[21] Appl. No.: 125,996

[22] Filed: Feb. 29, 1980

[51] Int. Cl.[3] ..... B63B 21/50

[52] U.S. Cl. ..... 114/230; 9/8 P

[58] Field of Search ..... 114/230; 9/8 R, 8 P; 405/212

[56] References Cited

U.S. PATENT DOCUMENTS

| | | | |
|---|---|---|---|
| 4,088,089 | 5/1978 | Flory | 9/8 P X |
| 4,114,556 | 9/1978 | Orndorff, Jr. et al. | 114/230 |
| 4,193,368 | 3/1980 | De Graaf et al. | 114/230 |
| 4,226,204 | 10/1980 | Tuson | 114/230 |

FOREIGN PATENT DOCUMENTS

| | | | |
|---|---|---|---|
| 2411755 | 8/1979 | France | 114/230 |

*Primary Examiner*—William A. Cuchlinski, Jr.

*Attorney, Agent, or Firm*—Freilich, Hornbaker, Wasserman, Rosen & Fernandez

[57] ABSTRACT

A SALM (single anchor leg mooring) terminal is described, of the type which includes apparatus mounted on the moored vessel for applying tension to the anchor leg so as to avoid the need for a large float at its upper end, which is of simple and reliable construction and which occupies little or no space on the permanently moored vessel. The system includes a yoke having a middle portion pivotally connected to the moored vessel, an inner end connected to the top of the anchor leg, and an outer end which lies outboard of the ship and which carries a counter weight, so that downward force applied by the counter weight produces an upward force on the anchor leg. By mounting the counter weight outboard of the vessel, large up-and-down swinging movement of the yoke can be accommodated without drastic modification of the vessel, and a simple pivoting system can be utilized to apply the necessary tension to the anchor leg.

6 Claims, 4 Drawing Figures

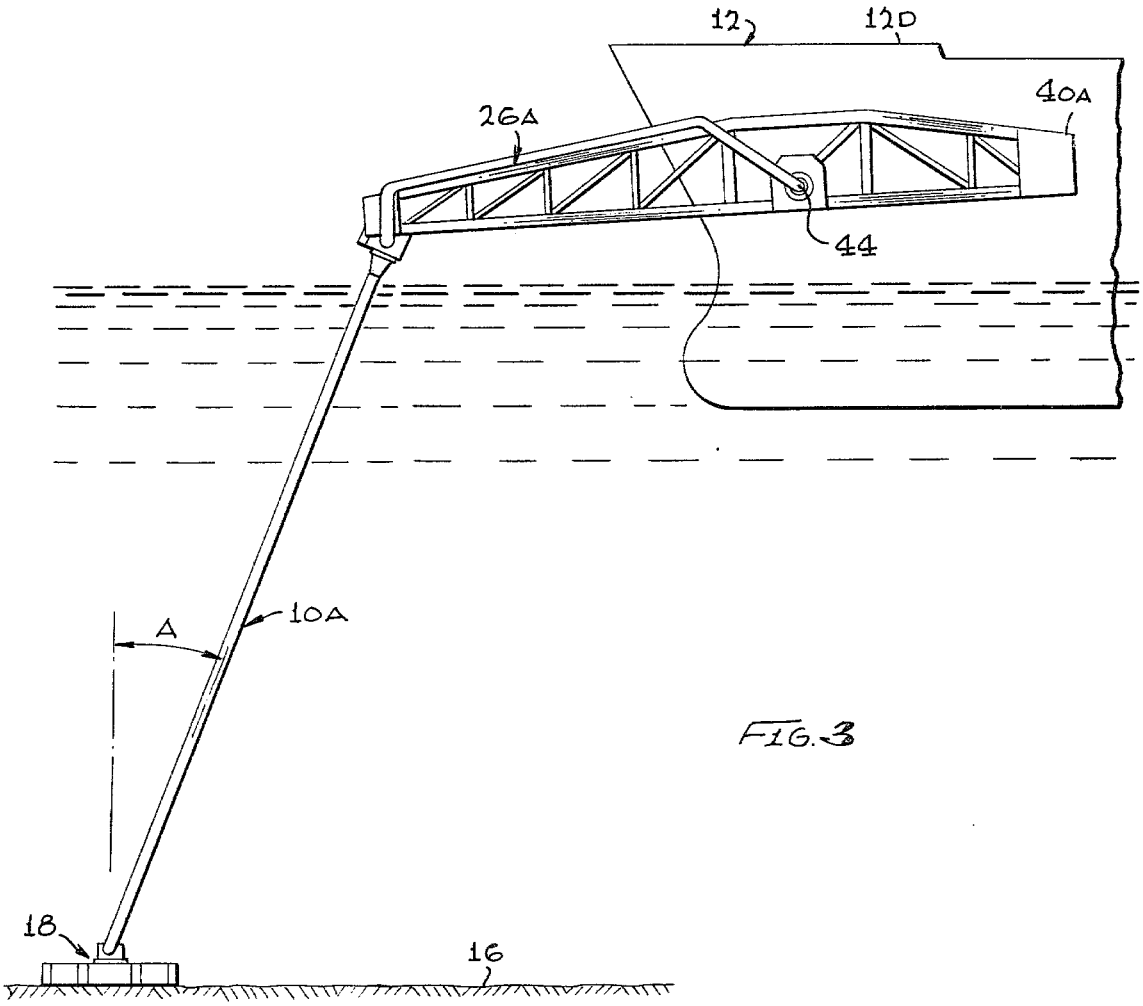
FIG. 3
FIG. 4
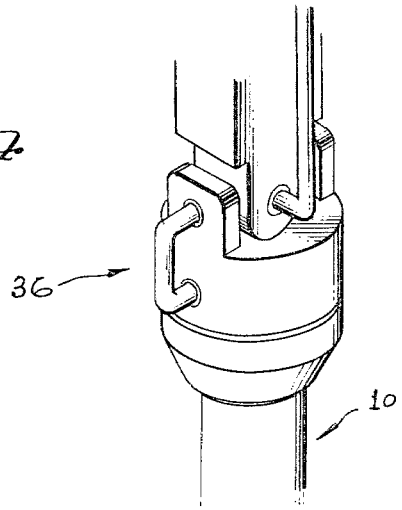

RISER-TO-VESSEL-MOORING-TERMINAL

BACKGROUND OF THE INVENTION

A production terminal can include a permanently moored vessel for storing and/or processing hydrocarbons from undersea wells for later transfer to a tanker. One type of mooring apparatus for such a terminal is the SALM (single anchor leg mooring) type which includes an anchor leg having a lower end anchored to the sea floor and an upper end which lies near or above the sea surface and is connected by a yoke or the like to the vessel. Conventional SALM terminals have often utilized a buoy near the top of the anchor leg to assure that the leg is always under tension, so that a long slender anchor leg can be utilized which can withstand large tension forces but which would buckle under a low compression load. However, the large buoy has several disadvantages, including sensitivity to waves and currents and added expense.

One approach to eliminating the need for a large buoy on the anchor leg is to utilize a device mounted on the dedicated vessel to apply a constant upward force to the top of the anchor leg. U.S. Pat. No. 4,088,089 by Flory shows several systems of this type wherein various devices on the vessel are employed to apply tension to the anchor leg. Such devices on the vessel include a counter weight which moves within a shaft formed in the vessel and which is connected to a cable to the anchor leg, a vertical piston on the vessel which is connected by a cable to the anchor leg, a winch on the vessel, and a counter weight mounted on a yoke lying over the vessel deck and with the counter weight lying even higher above the deck. While all of these approaches can apply tension to the anchor leg, they have serious disadvantages. The application of forces through cables involves the use of several vulnerable moving parts that decrease reliability. The use of a counter weight high above the vessel deck subjects the system to instabilities, due to the great height of the counter weight, which is necessary to permit considerable downward pivoting by it, and also requires isolated deck region on the vessel to accommodate the counter weight when it moves downwardly. A mooring system of the type which utilized an apparatus near the sea surface other than a buoy on the vessel to apply upward forces on a SALM that anchors a dedicated vessel, but which was of simple and reliable construction, would be of considerable value.

SUMMARY OF THE INVENTION

In accordance with one embodiment of the present invention, a mooring system of the SALM (single anchor leg mooring) type is provided for a dedicated vessel, and that is of the type which utilizes apparatus coupled to the vessel to apply constant tension to the anchor leg, which is of simple and reliable construction. The system includes a yoke or other structural member having a middle portion pivotally connected to the vessel, an inner end connected to the top portion of the anchor leg, and an outer end which carries a heavy weight, with at least the outer end lying outboard of the vessel. Accordingly, when the vessel drifts far from an initial position so that the anchor leg and structural member undergo large pivoting movements, the weight at the outer end of the structural member can undergo a large excursion without interference from the vessel and without radically adapting the vessel to accommodate such movements.

In one mooring system, the structural member is formed as a yoke with two arms lying on opposite sides of the bow of the vessel and pivotally connected to the outside of the vessel at a location lower than the deck of the vessel. With the pivotal axis of the yoke and the counter weight lying at a relatively low height which is below the level of the vessel deck, the weight does not unduly destabilize the vessel, and the weight can apply a relatively constant torque throughout movement of the anchor leg and vessel from their initial positions.

The novel features of the invention are set forth with particularity in the appended claims. The invention will be best understood from the following description when read in conjunction with the accompanying drawings.

BRIEF DESCRIPTION OF THE DRAWINGS

FIG. 3 is a view similar to FIG. 1, but showing the system wherein the vessel and anchor leg are displaced from an initial quiescent position.

FIG. 4 is a partial perspective view showing the coupling between the upper end of the anchor leg and the inner end of the yoke of FIG. 1.

DESCRIPTION OF THE PREFERRED EMBODIMENT

Figure 1:
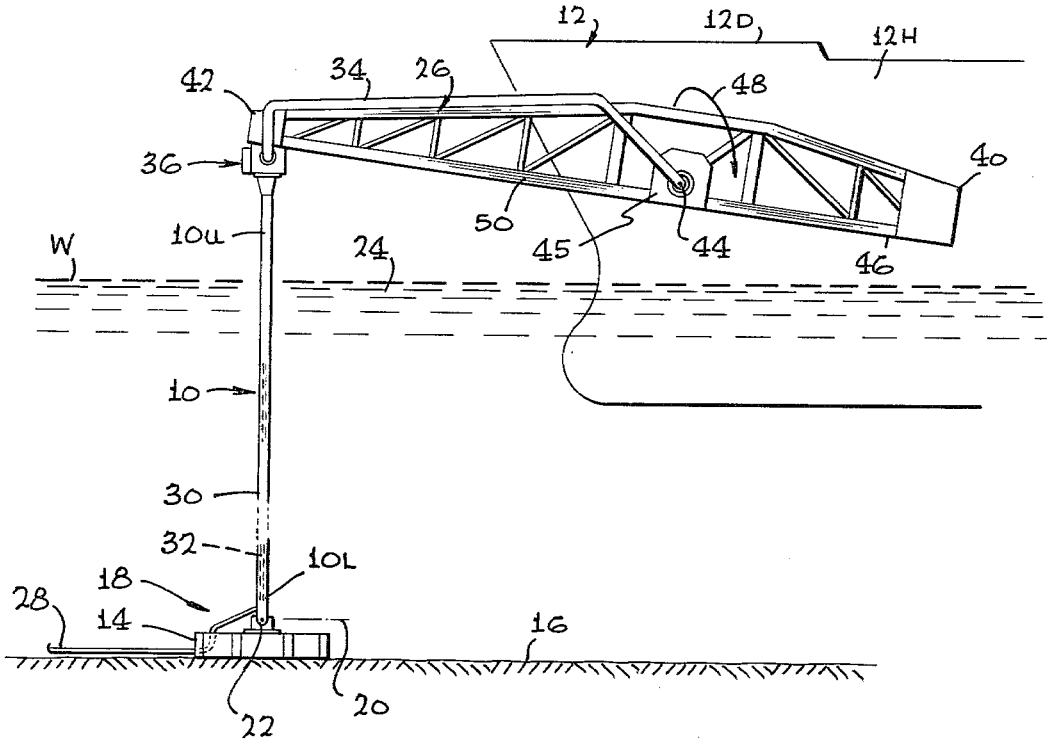
FIG. 1 is a side elevation view of a mooring system constructed in accordance with the present invention.

FIG. 1 illustrates a mooring system which utilizes a single anchor leg 10 to moor a dedicated vessel 12 floating offshore in a body of water W. The single anchor leg or riser 10 has a lower end 10L which is connected to a base 14 at the sea floor 16 by a tilt joint 18 which permits the leg 10 to pivot about two horizontal axes 20, 22. The upper end 10U of the anchor leg extends to a height at least near the surface 24 of the sea, and preferably extends somewhat above the surface when the leg is in its vertical or quiescent position. The upper end of the anchor leg is connected by a structural member 26 to the vessel 12, the structural member 26 being a yoke capable of withstanding both compression and tension forces along its length to keep the vessel and anchor leg separated by a predetermined distance.

The mooring system can be utilized not only to moor the vessel 12, but also to connect it to an underwater pipeline 28 which may extend to subsea hydrocarbon wells, to transfer oil from the wells to the vessel 12 so that the vessel can store the oil until it can be transferred to a tanker. In this connection, a conduit 30 is provided which connects the underwater pipeline 28 to the vessel, with the conduit 30 including a portion 32 which extends within the anchor leg 10 and another portion 34 which extends along the yoke 26 to the vessel. The upper end of the anchor leg 10 is connected by a triaxial swivel 36 to the yoke 26, with the triaxial swivel permitting pivoting about three axes. This permits the yoke 26 to tilt about two horizontal axes, and also to rotate without limit about the vertical axis to accommodate movement of the vessel 12 about the anchor leg 10 under the influence of wind, waves, and currents.

The yoke or structural member 26 which extends between the upper end of the anchor leg 10 and the vessel 12, not only serves to connect them, but also serves to apply a constant tension to the anchor leg 10. A single anchor leg of great length may be needed to extend from the sea surface to the sea floor, but it need only to of small diameter so long as it is always under tension. Where the anchor leg 10 is a relatively rigid pipe, it must not be allowed to undergo compression, since it will buckle and become damaged under a relatively light compression loading. It may be noted that a substantially rigid pipe is useful as a single anchor leg to enable a substantially rigid pipe to be utilized as the riser portion 32 of the fluid conduit, which is advantageous because such pipes are more reliable than flexible hoses. The anchor leg can be a chain and with a flexible hose extending along the chain or separately, but even such a single chain should be maintained under tension in order to effectively moor the vessel. In the prior art, the maintenance of tension in the anchor leg has been accomplished by the use of buoyancy, as by applying a large diameter buoy near the upper end of the anchor leg. However, such a buoy is sensitive to currents and waves, so that it causes the anchor leg to be deflected by waves, thereby making it less effective in counteracting the action of waves on the storage vessel. In addition, the buoy is cumbersome and expensive as is the use of multiple buoys along the height of the anchor leg or the use of a large diameter self buoyant anchor leg.

In order to avoid the need for a large buoy on the anchor leg 10, the structural member 26 is formed with a counter weight 40. The structural member 26 has an inner end 42 which is coupled to the upper end of the anchor leg 10, a middle portion 45 which is connected at an axis 44 to the vessel 12, and an outer end 46 which carries the counter weight 40. The structural member 26 can pivot with respect to the vessel about the substantially horizontal axis 44, so that the downward force of gravity on the counter weight 40 results in an upward force on the inner end 42 of the structural member and on the anchor leg 10. The actual amount of force depends, of course, not only on the mass of the counter weight 40 and of other parts of the system, but on the relative distances between the pivot axis 44 and the inner and outer ends of the structural member where it connects to the anchor leg 10 and weight 40. The weight/distance distribution of the outer end of the structural member 26 is chosen so that it produces a greater torque tending to pivot the structural member in the direction of the arrow 48 than the inner portion 42 of the structural member, so that a constant upward force is applied to the top of the anchor leg 10. In fact, the torque is great enough to counteract the net weight of the anchor leg 10 (its weight minus its buoyancy) so that an upward force is applied by the anchor leg 10 to its deep-underwater tilt joint 18 to maintain a constant upward force on the tilt joint. It may be noted that the system utilizes the buoyancy of the moored vessel 12 to apply an upward force to the anchor leg 10, with the structural member 26 serving to transfer the forces.

When the anchor leg 10 moves from the initial or quiescent position shown in FIG. 1 to the deflected position shown in FIG. 3, the anchor leg tilts to the position 10A while the structural member 26 pivots to the position 26A. The raising of the weight 40 to the position 40A results in the storing of potential energy, and the weight 40A helps to apply a force tending to restore the vessel and anchor leg to the quiescent position. It can be seen that the structural member 26 undergoes considerable pivoting, and that the inner end 46 which overhangs the pivot axis 44 by a long distance, undergoes a considerable up and down movement as the vessel moves away and towards the quiescent position. It would be possible to construct the system so that the weight 40 lay within the hull 12H of the vessel, but this would require drastic modification of the vessel or the raising of the horizontal pivot axis 44 to a high level above the deck 12D of the vessel. The location of the pivot axis 44 above the hull 12H of the vessel and therefore the deck would tend to add instability to the vessel, since forces applied to the vessel would be far above the center of buoyancy of the vessel. Also considerable deck space would be required not only to pivotally mount the structural member, but also to provide a clear area to accommodate the weight 40 when it moves to its extreme downward position.

Figure 2:
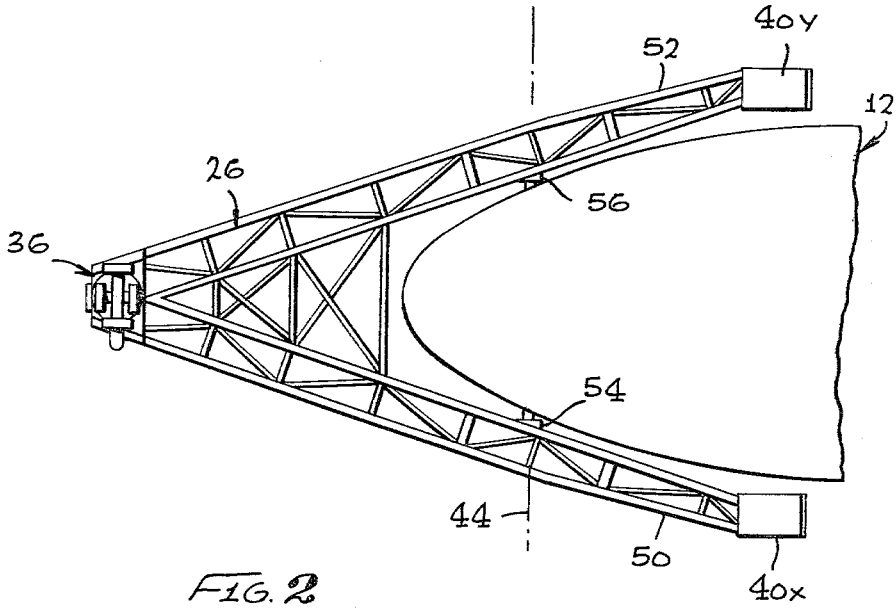
FIG. 2 is a plan view of the system of FIG. 1.

In accordance with the present invention, a relatively simple counter weight system is provided by mounting the outer end 46 of the pivoting structural member, including the weight 40, outboard of the vessel. As shown in FIG. 2, this can be accomplished by constructing the structural member 26 in the form of a yoke, with two arms 50, 52 lying on the port and starboard sides of the bow end of the vessel and outboard of the vessel hull. Each arm is pivotally connected to the vessel by a bearing structure 54, 56 extending outwardly from the side of the vessel, and the weight 40 is constructed in the form of two separate weights 40X and 40Y lying at the ends of corresponding yoke arms 50, 52. The vessel 12 can be of conventional design, with only the yoke mounts 54, 56 added, and yet large vertical excursions of the weights 40X, 40Y can be permitted. By utilizing a structural member 26 lying outboard of the vessel 12, a relatively simple counterweight system is provided which utilizes only pivoting connections and which permits a relatively low center of gravity for the yoke and particularly for the weights thereon.

Thus, the invention provides a mooring system of a type which includes a single anchor leg connected by a structural member to a dedicated vessel and wherein a structure on the vessel provides outward forces to the anchor leg to maintain it in tension, which is of relatively simple and reliable design. This is accomplished by utilizing a counter weighted yoke or other structural member that connects the ship to the anchor leg, wherein the overhanging weighted outer end of the structural member lies outboard of the ship so that it can undergo considerable vertical excursions without the need for special ship designs for accommodating such motion, without necessitating the mounting of the weighted outer end at a high level above the ship deck to accommodate such motions, and without requiring considerable space on the ship to be utilized to permit large counter weight excursions.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A mooring system for mooring a vessel floating offshore in a body of water, comprising:

a mooring leg extending primarily vertically between a location near the bottom of said body of water and a location at a height at least near the surface of the body of water;

a rigid structural member coupled to said vessel and having an inner end connected to the upper end portion of said mooring leg;

said structural member having a weighted outer end opposite said inner end and lying outboard of said vessel, and having an intermediate location between said ends which is pivotally connected about a substantially horizontal axis to said vessel, the outer portion of said structural member which lies beyond said horizontal axis, having a weight-distance distribution which produces a greater torque on said structural member tending to lift the inner end thereof than is produced about said axis by the inner portion of said structural member by its own weight and the net weight of said mooring leg, whereby to exert an upward force on said leg.

2. The system described in claim 1 wherein:

said structural member is in the form of a yoke with a pair of arms having outer portions lying outboard respectively on the port and starboard sides of an end portion of said vessel, and with a counterweight on the outer portion of each arm.

3. The system described in claim 1 wherein:

the location of said horizontal axis, and a majority of said structural member including the weighted outer end, lie below the level of the top of the hull of said vessel and at a location inward of the nearest end of the vessel.

4. In a single anchor leg mooring system wherein a dedicated vessel coupled to the upper portion of the anchor leg can apply an upward force to the anchor leg, the improvement comprising:

a yoke having an inner end portion pivotally connected to the upper portion of said anchor leg and an outer end portion, said yoke including a pair of arms with outer arm ends lying outboard of said vessel on either side thereof and inner arm ends lying beyond an end of said vessel, said arms of said yoke each having a middle portion that lies between the inner and outer arm ends thereof and that is pivotally mounted on said vessel;

said outer ends of said arms being weighted so the yoke tends to pivot in a direction wherein said outer arm ends would move down, and said outer arm ends each lie so they can move down to a level below the deck of the vessel without interference with the vessel.

5. The improvement described in claim 4 wherein:

said arms of said yoke are each pivotally connected to said vessel about a substantially horizontal axis that lies at a height below the deck of the vessel and that passes through the vessel at a location spaced from an adjacent end of the vessel.

6. The improvement described in claim 4 wherein:

said yoke is positioned so that when said anchor leg is vertical then the yoke is oriented with its inner end higher than its outer end, whereby to permit a greater vessel drifting distance before the inner end moves down to near the water surface.

* * * * *